United States Patent [19]

Stewart

[11] Patent Number: 4,461,477

[45] Date of Patent: Jul. 24, 1984

[54] METHOD AND APPARATUS FOR IMPROVING THE PERFORMANCE OF A BATTER

[76] Inventor: Eddie A. Stewart, 3230 Healy Dr., Nashville, Tenn. 37207

[21] Appl. No.: 388,127

[22] Filed: Jun. 14, 1982

[51] Int. Cl.[3] ..... A63B 71/02

[52] U.S. Cl. ..... 273/26 R; 273/26 R; 273/26 A; 273/186 C; 434/247

[58] Field of Search ..... 273/26 R, 26 A, 26 B, 273/88, 181 H, 181 E, 183 R, 183 A, 186 R, 186 B, 186 C, 186 RA; 434/247; 124/83; 340/323

[56] References Cited

U.S. PATENT DOCUMENTS

| | | | |
|---|---|---|---|
| 2,113,899 | 4/1938 | Oram | 273/26 A |
| 3,157,399 | 11/1964 | Gaudet | 273/26 A |
| 3,229,975 | 8/1962 | Tompkins et al. | 273/26 A |
| 3,913,915 | 10/1975 | Carmen | 273/88 |
| 3,915,143 | 10/1975 | Waller | 124/83 |
| 4,101,132 | 7/1978 | Conrey et al. | 434/247 |
| 4,146,230 | 3/1979 | Foster | 273/183 R |
| 4,254,956 | 3/1981 | Rusnak | 273/181 H |
| 4,304,406 | 12/1981 | Cromarty | 273/DIG. 28 |
| 4,381,864 | 5/1983 | Bromley et al. | 273/88 |

FOREIGN PATENT DOCUMENTS

| | | | |
|---|---|---|---|
| 2234908 | 1/1975 | France | 273/183 A |

*Primary Examiner*—Richard C. Pinkham
*Assistant Examiner*—Mary Ann Stoll
*Attorney, Agent, or Firm*—Pitts, Ruderman & Kesterson

[57] ABSTRACT

The method and apparatus for improving the performance of a batter. The apparatus includes sequencing lights (38) which are representative of a ball moving toward an impact zone. Further included are light indicia (46 and 48) which inform a batter that the pitched ball will either be a ball or a strike so that the batter may determine whether or not he should swing the bat. Also included are means to generate an electrical signal to indicate that the strike light (46) is illuminated. First and second light beams (18 and 20) are provided which pass through the ball/bat impact zone and are located at selected and known distances apart such that the bat swing through the impact zone will sequentially interrupt both first and second beams (20 and 18). First and second sensors (22 and 24) are also located for receiving and sensing the presence of the first and second beams and provide second and third electrical signals, respectively, if the beams are interrupted. Circuitry is included for measuring and displaying both a first elapse time (corresponding to batter response) between the occurrence of the first and second electrical signals and also a second elapse time (relative to bat velocity) between the second and third electrical signals.

9 Claims, 5 Drawing Figures

Fig. 2A
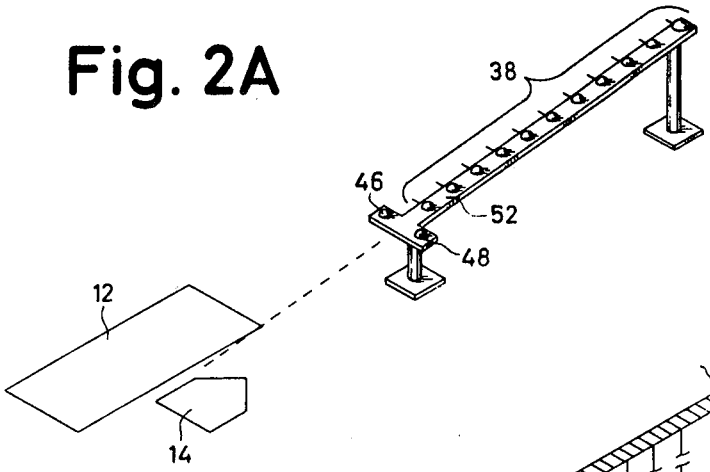
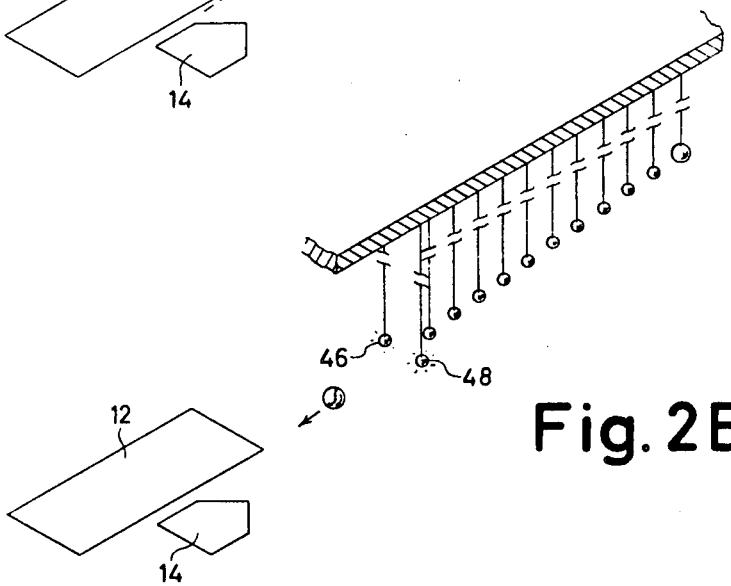
Fig. 2B
Fig. 3
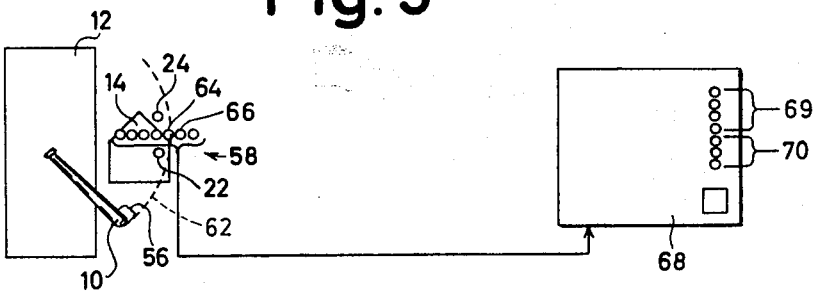

METHOD AND APPARATUS FOR IMPROVING THE PERFORMANCE OF A BATTER

TECHNICAL FIELD

This invention relates to method and apparatus for determining the speed of an item moving through a selected distance and more particularly a method and apparatus for determining the response time of a batter as is present in the games of baseball and softball, and the speed of the bat as it passes through the strike zone or ball/bat impact zone.

BACKGROUND ART

As is well known by those skilled in the art, the skill of a batter in the games of baseball and softball is determined by several factors including: judgment or ability of the batter to know when to swing at a ball which will be in the strike zone, the ability of the batter to make a decision to swing and then get the bat off of his shoulder and into the ball/bat impact zone or response time, and the speed of the bat at the time of impact with the ball. Consequently, as is also well known by those skilled in the art, the ability of a batter to hit a "long ball" is not necessarily only related to the strength of the batter. That is, it is not uncommon for a smaller batter to sometimes be able to hit a ball harder and longer than a larger and stronger batter. Also as is well known in the art, some batters have an eye for the ball and are able to respond with a quick bat swing such that contact of the bat and the ball will take place when the ball moves into the "impact or strike zone." It is also, of course, well known that the size of the bat itself may affect both the response time of the batter and the speed of the bat as it passes through and contacts the ball in the impact or strike zone. Therefore, one of the purposes of the present invention is to be able to determine the response time of a batter with a particular bat.

Another object of the present invention is to be able to determine the bat speed of the bat as it passes through a selected area of the strike zone. Therefore, it will be appreciated that if both the bat speed and the response time of a batter can be determined with respect to a selection of different bats, sizing the bat for a particular batter to achieve the fastest response and to achieve the greatest bat speed for more distance becomes possible.

A review of the prior art references related to the present invention indicates there are several patents which disclose techniques for measuring the speed of a moving object by means of a light beam. The U.S. Pat. No. 3,145,025 issued to J. H. Morrison, et.al. on Aug. 18, 1964, for example, measures the speed of a bowling ball as it travels the length of the alley between a first light beam and sensor located near the upper end or the foul line of the alley and a second light beam and sensor located approximate the first pin at the opposite end of the alley. The bowling ball starts a time circuit when it crosses the first light beam and stops the timing circuit when it crosses the second light beam. In a similar manner, the U.S. Pat. No. 3,567,951 issued to Montgomery, et.al. on Mar. 2, 1971, and the U.S. Pat. No. 4,097,800 issued to J. Kuchmas, Jr., et. al. on June 27, 1978, disclose techniques which use a laser beam to measure the speed or velocity of a projectile such as a bullet or rocket. According to each of these patents, intersecting the first laser beam will initiate counting circuitry, and the intersection of the second laser beam will terminate the counting. The speed of the rocket or bullet is then computed by the number of clock pulses occurring during the time required for the projectile to cross the two laser beams. The Kuchmas Patent uses a single laser beam which is reflected a number of times between two reflecting plates wherein each reflection is displaced a slight distance from the previous reflection until at the end of the plate a sensor is triggered by the reflection. The speed of the projectile is determined by triggering counter circuitry at the moment of firing the projectile and terminating the counter circuitry whenever the projectile intersects one of the beams reflected between the two parallel plates. Other patents such as the U.S. Pat. No. 3,685,909 issued to L. L. Schwartz on Aug. 22, 1972, and the 2,571,974 Patent issued to J. Walker on Oct. 16, 1951, are similar in that they relate to techniques for determining the speed of a golf club. According to the Schwartz Patent, the speed of the golf club is determined as the head of the golf club breaks the first beam to start a timing circuitry and then breaks a second beam to terminate the timing circuitry in the same manner as was discussed above. The Walker Patent also determines the speed of a golf swing, but instead of using a horizontal light beam it uses a series of vertical beams for providing a positive "score" if the club breaks the proper light beams and a negative "score" if the club breaks certain light beams outside the proper swing area.

Thus from the above, it is seen that although laser beams have been used to measure the speed of items through light beams, nowhere in the prior art have there been techniques or devices suitable for use in determining the response time of a batter, or for determining the bat speed of the batter as the bat crosses the strike or impact zone such that the batter can properly choose a bat having a size more appropriate for his size and physical abilities.

Therefore, it is an object of this present invention to provide effective and inexpensive methods and apparatus for determining the response speed of a batter and the bat speed of a bat through a strike zone to allow proper selection of a bat which is appropriate for a particular batter.

It is another object of this invention to provide methods and apparatus for providing information to allow constructive coaching techniques to determine any correlation existing between batting skill, response time and bat velocity.

DISCLOSURE OF THE INVENTION

Other objects and advantages will in part be obvious and will appear hereinafter, and will be accomplished by the present invention which provides methods and apparatus for improving the performance of a batter in the game of softball or baseball by monitoring the response time of the batter and the velocity of a bat as the bat moves through a selected ball/bat impact or strike zone. The apparatus comprises a sequencing means to provide sequencing light indicia which is representative of a ball moving towards the ball/bat impact zone. Additional light indicia, which appears subsequent to the sequencing light indicia, informs the batter whether or not the "ball" will pass through the ball/bat impact zone. Means are also included to generate a first electrical signal when the additional light indicia appears. There is a first and second means, such as first and second laser means, for providing beams of light which pass through the ball/bat impact zone. These means for providing beams of light are located such that the beams of light are at selected and known distances apart, and such that a bat swung through the impact zone interrupts both of the light beams. First and second sensor means sense the presence of the light beams, and provide second and third electrical signals representative of the interruption of the light beams. Circuitry receives the electrical signal from the sequencing means and the first and second sensing means and measures a first elapsed time between the first and second electrical signals, and a second elapsed time between the second and third electrical signals. Means are also provided so that the first elapsed time may be displayed in time units, and the second elapsed time can be displayed in velocity units.

BRIEF DESCRIPTION OF THE DRAWINGS

Accordingly, the above mentioned objects and subsequent description will be more readily understood by reference to the following drawings wherein:

FIGS. 2A and 2B show alternate embodiments of FIG. 1 for displaying the sequencing lights indicative of the travel of the ball.

FIG. 3 shows a diagramatical view of apparatus for determining the position of the end of the bat as it swings through the strike or ball/bat impact zone.

BEST MODE FOR CARRYING OUT THE INVENTION

Figure 1:
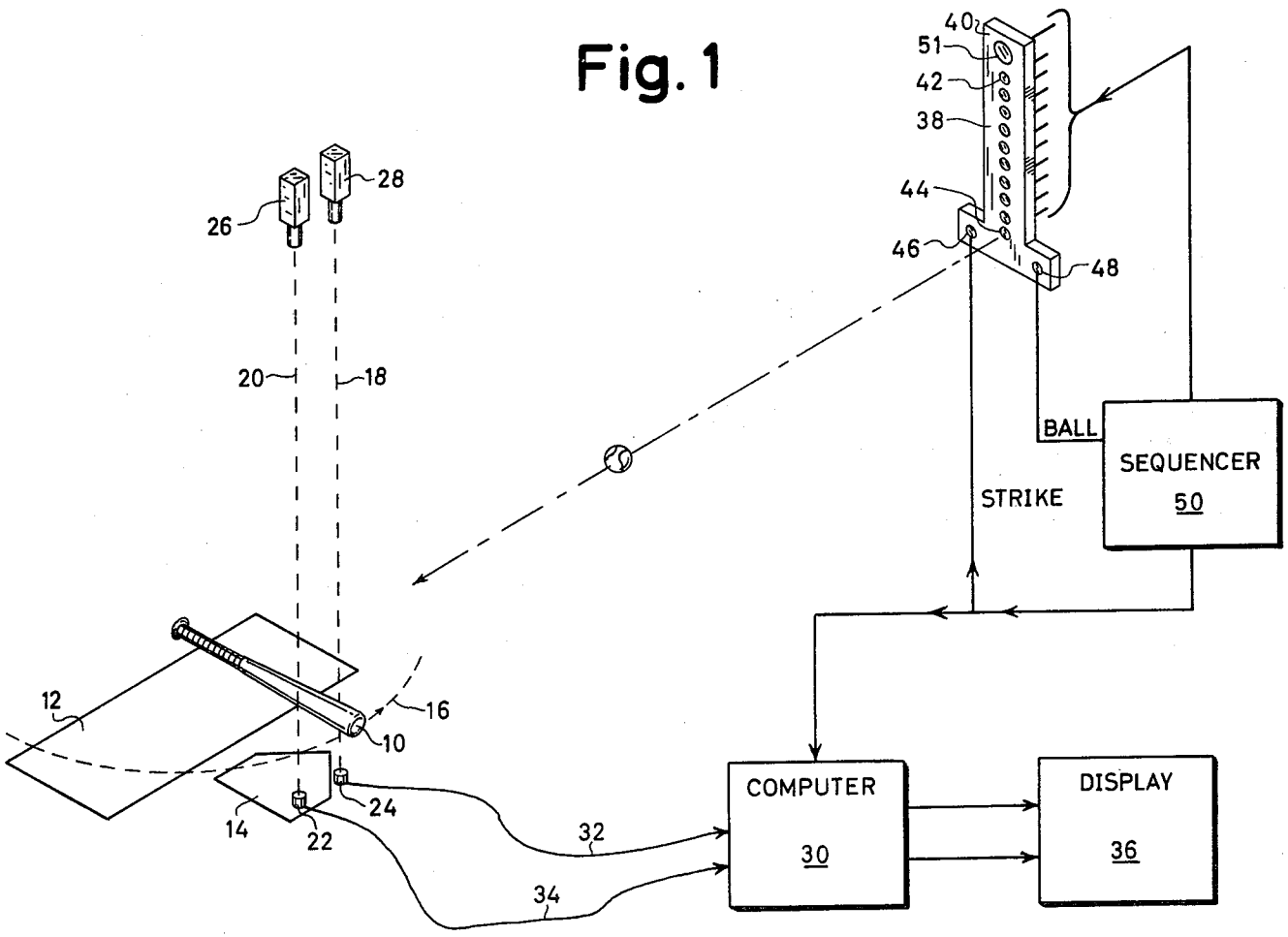
FIG. 1 is a diagramatical illustration of a players "bat swing" training device incorporating the features of this invention.

Referring now to FIG. 1, there is shown a diagrammatical pictorial view of the device of this invention for training batters. As shown, bat 10 will be swung by player (not shown) standing in the batter's box 12 in a position to protect the strike zone or ball/bat impact zone adjacent the plate 14. As the pitched ball approaches the batter, the batter will decide whether or not to swing at the ball. If the batter decides to swing at the ball, he will typically swing bat 10 through an arc 16 in an attempt to make contact with the pitched ball. According to the present invention, a pair of light beams such as laser beams 18 and 20 are generated either above or below the batter and directed toward a pair of sensors 22 and 24 which in the embodiment shown in FIG. 1 are below the generating means. Sensors 22 and 24 are suitable for receiving and sensing the presence of light beams thereon. In the embodiment shown, the laser beams 18 and 20 are being generated by two separated lasers 26 and 28 although it will be appreciated by those skilled in the art that a single laser generating means could be used along with a beam splitter to provide or create the two separate beams 18 and 20. Although not shown, it will be appreciated, of course, that the laser generating means 26 and 28 will require some power source whether it be battery or commercial so that the laser beams can be generated. A computational circuitry 30 is connected by wires 32 and 34 to sensors 24 and 22 respectively. As will be discussed hereinafter, computation circuitry 30 receives electrical signals from sensors 22 and 24 respectively such that they can be used to determine the amount of time which elapses between the interception of light beam 20 by bat 10 and the interception of the second light beam 18 by bat 10. The amount of elapsed time as computed by computational circuitry 30 can, of course, be directly related to speed or velocity in terms such as miles per hour, feet per second, kilometers per hour or any other desired terms. This is easily accomplished if the distance between the two sensors which receive the two light beams 20 and 18 is precisely known. Once the elapsed time has been determined, this information may then be provided to display panel 36 which can display the elapsed time in any desired format.

As is well known in the art of baseball, the bat swing speed alone is not the only factor which determines whether a batter is a good hitter. For example, if a fast ball is traveling towards the batter, he must be able to determine where the ball is going to be, get the bat off the shoulder and swing around to the strike zone to a precise location if the bat 10 is to make contact with the approaching ball. Thus, there is an important time period hereinafter referred to as the response time between the instant the batter decides he will swing at the ball and until he is able to actually move the bat 10 to the strike zone area. To be able to record this response time, the present invention further includes a sequence of lights 38 which represent the movement or approach of the ball from the pitcher to the batter. According to one embodiment, the sequence of lights may be mounted at some distance in a vertical direction on an inverted T-shaped frame 40. In this instance, the sequence of lights 38 operate by having the first light 42 illuminated which is then followed by the next lower light which in turn is followed by a still lower light. This continues until the complete sequence of lights have been turned on and then turned off. After the last light 44 of the sequence 38 is illuminated, then either a "strike" light 46 or a "ball" light 48 is illuminated to instruct the batter whether or not to swing his bat. If the strike light 46 is illuminated after the sequencing of lights 38 is completed, a signal is provided to computation unit 30 to a first unit which will measure time between the instant of illuminating the light 46 until the first light beam 20 is intercepted by the batter's bat 10 when the batter swings. In a manner similar to that discussed heretofore with respect to determining the speed of a bat swing, this measured elapse time is then provided to display panel 36 such that the response time of the batter which is measured from the instant the strike light is illuminated until he swings his bat into the strike zone and crosses beam 20 can be determined. As shown, circuitry 50 provides the necessary signals to illuminate the sequence of lights 38 and also to illuminate the strike light 46 or the ball light 48. Also as shown in this particular embodiment, a wind-up light 51 representing the pitchers wind up which takes place before he delivers his pitch is also included so that the batter will be warned that the ball will shortly be on its way.

Referring now to FIGS. 2A and 2B, there are shown alternate arrangements for providing the sequence of lights representing the pitched ball, and the information "strike" and "ball" lights which instruct the batter to either swing the bat or not to swing. According to these embodiments, rather than a vertical sequence of lights mounted at some distance away, the lights will actually be mounted horizontally such that the sequence of illuminating lights actually approach the batter as though it were the ball traveling from the pitcher's mound to the batter. As shown in FIG. 2A, this sequence of light could be mounted on a substantially horizontal table 52, or alternately as shown in FIG. 2B, each of the lights could be suspended from above such that the lights are sequenced on and the sequencing actually moves toward the batter.

As will also be appreciated by those skilled in the art, it is of no significance how fast the batter can swing his bat or his response time if he cannot in fact make contact with the moving ball. Further, it is important that if the ball is to have any great travel, the bat should make contact with the ball at the heavier end portion. Therefore, as shown in FIG. 3, there is additional circuitry for determining the position of the batter's bat during his swing to assure that the proper portion of the bat will be in the strike zone to meet the pitched ball. Elements of FIG. 3 which are the same as those discussed with respect to FIGS. 1 and 2 above will carry the same reference number. In a similar manner, elements of the remaining FIG. 4 which are the same as those already discussed will also carry the same reference number. Referring now to FIG. 3 there is shown the batter box 12 wherein the batter stands for purposes of swinging his bat 10 when the ball is pitched and passed over the plate 14. The batter will, of course, typically swing his bat to make contact with the ball. However, to gain the most distance with the ball once it does makes contact with the bat, it is preferable that the bat contact the ball at the heavy part of the bat 56. To help determine where the batter usually swings the bat and at what point portion 56 of the bat a0 swings through the strike zone, there is provided circuitry and devices which include a curtain 58 of light beams which are received by a multiplicity of sensors in the same manners as was discussed above with respect to sensors 22 and 24. As shown, the multiplicity of sensors and the curtain of light beams are arranged and located such that they are vertical, and are received by the sensors when proximate to the plate portion. As can be seen in the diagram of FIG. 3, when swung along the arc 62, the bat will intersect only the light beams from light beam 64 back toward the batter's box 12 but will not intersect beam 66 or any beam further away from the batter's box 12. When the bat intersects the light beams, the multiplicity of sensors corresponding to the light beam 64 and those other light beams closer to the batting box 12 will sense that the light beams have been intersected and will provide this information to circuitry and display box 68. The control circuitry in box 68 simply includes a series of switching means which are triggered by the interruption of each of the particular light beams which will then turn on a series of lights whih corresponds to the multiplicity of sensors and light beams. That is, lights in section 69 would all be illuminated to indicate that the bat intersected the beams associated with these lights and the remaining lights in section 70 will not be illuminated. Thus, the position of the end of the bat during the batter's swing through the strike zone can be determined. Alternately, of course, all lights in sectiona 69 and 70 could initially be on such that the interrupted light beams would then turn off the lights in section 69.

In addition, the curtain of lights 58 and the circuitry 68 may be used to correlate and adjust the measured speed of the bat as determined by the circuitry of FIG. 1 with the actual speed of end portion 56 which may be significantly higher since the end portion 56 may not be the portion which intersects laser beams 18 and 20. To accomplish this, circuitry 68 may include compensating means for providing and adjusting signal to computational circuitry 30 which increases proportional as the distance between the point on the bat which intersects beams 18 and 20 and the end if the bat increases. This adjusting signal is then used to modify the output on display 36 such that a direct reading of the speed of bat end 56 may be determined regardless of the portion of the bat which intersects beams 18 and 20.

Figure 4:
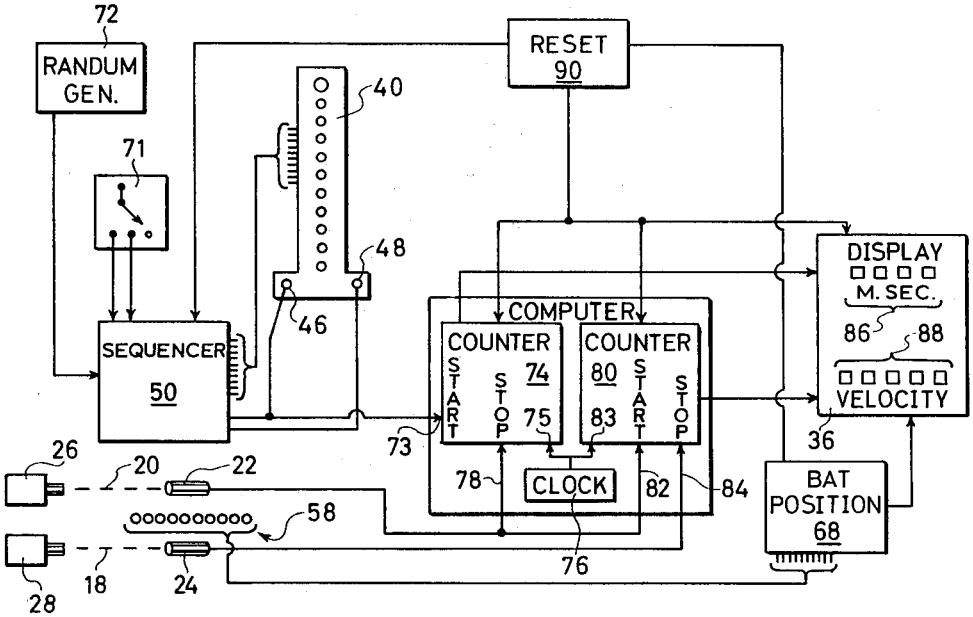
FIG. 4 shows a block diagram of circuitry of the present invention used to compute the response time and bat speed time.

Referring now to FIG. 4, there is shown a block diagram of circuitry suitable for determining the response time and bat speed of the apparatus of FIGS. 1, 2, and 3. As shown, there is a switching means 71 which operates in conjunction with sequencer 50, heretofore discussed, and a random generator 72, and the sequence of lights 38. In the embodiment shown, switch 71 may be positioned such that after the sequence of lights representing the advancement of the pitched ball is completed, the strike light 46 will always come on. Alternately, switch 71 may be set such that after the sequencing of lights 38 the ball light 48 always comes on. However, the third option of switching means 71 and perhaps the preferred use operates such that after the sequencing of lights is completed (representing the advance of the pitched ball), the random signal generator 72 will randomly select whether or not ball light 48 or the strike light 46 is to be illuminated. Thus, it will be appreciated that the operator of the system can determine whether the strike or ball light will be illuminated or the operator may set the system into an automatic mode such that the appearance of the ball or strike light is unpredictable. In any event, any time that the strike light 46 is illuminated a start signal is provided to the start input 73 of counter 74. In addition to the start input 73, there is also a clock input 75 which provides high frequency clocking pulses to counter 74. Thus, so long as the clock pulses are provided at input 75, when the start signal is received at input 73, counter 74 will accumulate or count the number of pulses received until the counter is stopped by a stop signal input on line 78. As can be seen, the stop input on line 78 results from the light beam 20 being interrupted in such a way that sensor 22 senses the interruption. Sensor 22 then provides the stop signal on line 78, but at the same time, provides a start signal to a similar counter 80 on line 82. Also in a similar manner, as was discussed with respect to counter 74, counter 80 also receives a clock pulse input at input 83. Thus, when counter 74 stops its count, counter 80 initiates its count. So in a similar manner counter 80 will continue to accumulate counts until a stop pulse is received on line 84. The stop pulse on line 84 is generated when sensor 24 determines that beam 18 has been interrupted. Thus, it will be recalled that light beam 20 will be first interrupted by the swing of the bat then light beam 18 which is a known distance from light beam 20 will subsequently be interrupted as the bat continues its swing through the strike zone. As shown, a signal representing the accumulated number of counts by counter 74 is then provided to display panel 36 where the number of counts may be displayed in terms of milliseconds or seconds as indicated by the indicators 86. In a similar manner, the output of counter 80 is also provided to display panel 36 so the counts it has accumulated may be displayed in units of time such as seconds or milliseconds, but prefereably may be displayed in velocity units such as feet per second, miles per hour, or kilometers per hour. This indication is indicated by the series of displays 88. It will be appreciated of course, that the output of counter 80 may be directly converted to velocity units rather than time units if the exact spacing between the light beam 18 and 20 is known. Finally, this circuitry, of course, includes reset means 90 by which the display 36, counters 74 and 80 the random sequence 72, and the light sequence 50 may be reset.

Thus, it will be appreciated that there have been described apparatus suitable for measuring and determining the response of a batter as well as his bat speed. If will further be appreciated by those skilled in the art that although the apparatus and circuitry described will be most helpful in determining the ability of individual batters, the apparatus may also be used to properly select a bat which is precisely matched to the player such that the player may be able to maximize his performance. That is, if it is determined that a batter is slow in his response time in getting the bat off of his shoulder and into the strike zone, bats of various sizes and weights may be tested to determine which bat helps increase the batter's response time. In a similar manner, if we assume that the batter has no problem with his response time, but does not seem to hit the "long ball" testing can proceed to determine where the heavy part of the bat intersects the strike zone, and what size and weight bat results in the highest velocity swing through the ball/bat impact zone for each player. It is believed, that this ability to properly size equipment to the batter may be of the greatest importance in aiding the batter's hitting performance.

Thus, although the present invention has been described with respect to specific methods and apparatus for providing training and information with respect to a batter, it is not intended that such specific references be considered limitations upon the scope of this invention except as insofar as is set forth in the following claims.

I claim:

1. Apparatus for improving the performance of a batter by monitoring the response time of the batter and the velocity of a bat as it moves through a selected ball/bat impact zone comprising:

sequencing means to provide a sequencing light having first indicia representative of a ball moving towards said impact zone, and second indicia which appears subsequent to said first indicia to inform said batter whether said ball will pass through said ball/bat impact zone, and means to generate a first electrical signal at the appearance of said second indicia when said second indicia indicates said ball will pass through said ball/bat impact zone;

first and second means for providing first and second beams of light respectively which pass through said ball/bat impact zone, said first and second means being located such that said beams of light are at a selected and known distance apart and such that a bat swing through said impact zone sequentially interrupts both of said first and second beams;

first and second sensor means for receiving and sensing the presence of said first and second beams respectively thereon, and for providing second and third electrical signals representative of the interruption of said first and second beams;

circuitry for measuring a first elapse time between the occurence of said first and second electrical signals, said first elapse time corresponding to said response time of said batter, and for measuring a second elapse time between said second and third electrical signals, said second elapse time being relatable to said velocity of said bat as it moves through said ball/bat impact zone; and means for displaying said first and second elapse time as a measure of said performance of said batter.

2. The apparatus of claim 1 wherein said first and second beams are laser beams.

3. The apparatus of claim 1 wherein said first and second beams of light are oriented to be substantially perpendicular with the earth's surface.

4. The apparatus of claim 1 wherein said first elapse time representation is displayed in seconds and said second elapse time determines the display of velocity.

5. The apparatus of claims 1, 2, 3, or 4 wherein said first indicia of said sequencing means includes a multiplicity of vertically positioned lights which are illuminated sequentially from a topmost light to a bottommost light to represent the forward travel of a pitched ball, and said second indicia of said sequencing means includes a strike indicator light informing said batter that said ball is a strike in said impact zone and he should swing, and a ball indicator light informing said batter said ball is not in said impact zone and not to swing, and further comprises random control means for randomly determining whether the strike or ball indicator light should illuminate after said sequential illumination of said multiplicity of vertically positioned lights.

6. The apparatus of claims 1, 2, 3, or 4 wherein said first indicia includes a multiplicity of horizontally positioned lights extending from a simulated pitcher's mound toward said batter, said multiplicity of lights are illuminated sequentially from a farthest light to a closest light to represent the forward travel of a pitched ball, and said second indicia includes a strike indicator light informing said batter that said ball is a strike and he should swing, and a ball indicator light informing said batter that said ball is not in said impact area and that he should not swing, and further comprises random control means for randomly determining whether said strike or ball indicator light should illuminate after sequential illumination of said horizontally positioned lights.

7. The apparatus of claims 1, 2, 3, or 4 further comprising: a curtain including a multiplicity of vertical, parallel light beams and corresponding light detectors, each of said multiplicity of light beams being positioned a selected distance from an adjacent one of said multiplicity of light beams, said curtain of light beams being positioned to extend across sad ball/bat impact zone between said first and second light beams such that as said bat is swung through said curtain, said bat interrupts only a portion of the multiplicity of light beams; and circuit means connected to said light detectors, including display means, whereby the position of the end portion of said bat being swung through said curtain can be determined by determining which light beams of said curtain were interrupted.

8. The apparatus of claim 7 wherein said second elapse time determines a velocity that is displayed, and further including compensating means for providing an adjusting signal to said means for displaying velocity such that said velocity represents the speed of said end portion of said bat.

9. A method for improving the performance of a batter's response time and for determining the velocity of a bat as it is swung by the batter through a selected ball/bat impact zone comprising the steps of:

sequencing the illumination of a multiplicity of lights to provide visible indicia representative of a ball moving towards said impact zone;

randomly illuminating one of two indicator lights after said illuminating step of said multiplicity of lights to instruct said batter to swing or not to swing and generating a first electrical signal upon illumination of said indicator light instructing said batter to swing;

providing first and second beams of light which pass through said ball/bat impact zone, said first and second beams of light being located at selected and known distances apart and such that a bat swung through said impact zone will sequentially interrupt said beams of light;

sensing the presence of said first and second beams of light thereon and providing second and third electrical signals representative of the interruption of said first and second beams of light;

determining a first elapse time between the occurrence of said first and second electrical signals corresponding to said batter's response times, and a second elapse time between said second and third electrical signals relatable to said velocity of said bat through said impact zone; and displaying said first and second elapse time to indicate said performance of said batter.

* * * * *